United States Patent [19]

Taylor

[11] Patent Number: 4,828,894

[45] Date of Patent: May 9, 1989

[54] CORRUGATED PLASTIC BOARD ASSEMBLIES

[75] Inventor: William Taylor, Riverdale, Ga.

[73] Assignee: United States Corrulite Corporation, Clewiston, Fla.

[21] Appl. No.: 78,568

[22] Filed: Jul. 28, 1987

[51] Int. Cl.[4] ..... B65D 3/24; B65D 5/50; A47F 1/04; A47F 3/14

[52] U.S. Cl. ..... 428/53; 47/66; 206/423; 229/49; 248/247; 248/311.2

[58] Field of Search ..... 428/52, 53, 174, 179; 220/4 F; 229/23 R, 49; 248/247, 253, 311.2; 47/40, 67, 68, 66; 206/423

[56] References Cited

U.S. PATENT DOCUMENTS

| | | | |
|---|---|---|---|
| 2,531,131 | 11/1950 | Johnson | 248/311.2 |
| 2,547,849 | 4/1951 | Barry | 229/23 R |
| 2,588,232 | 3/1952 | Grant | 229/23 R |
| 2,990,998 | 7/1961 | Barclay | 220/356 |
| 3,913,774 | 10/1975 | Vajtay | 220/4 R |
| 4,377,231 | 3/1983 | Murphy | 206/44 R |
| 4,637,544 | 1/1987 | Quercetti | 229/23 R |

FOREIGN PATENT DOCUMENTS

| | | | |
|---|---|---|---|
| 2305490 | 8/1974 | Fed. Rep. of Germany | 47/40 |
| 1124791 | 10/1956 | France | 47/40 |
| 1436322 | 5/1976 | United Kingdom | 47/68 |

*Primary Examiner*—Nancy A. B. Swisher
*Attorney, Agent, or Firm*—Perman & Green

[57] ABSTRACT

Assemblies of sheets of corrugated plastic board and molded plastic interlock elements providing useful products such as containers. Sheets of corrugated plastic board are interlocked with one another by means of molded plastic connector pieces or strips having receptor slots containing spaced lock ramps. The slots receive a uniform edge of a sheet of corrugated plastic which is provided with spaced slits aligned with the spaced lock ramps. Entry of the sheet edge into the connector slot causes the spaced lock ramps to compress the edge until the aligned slits pass thereover, and the "memory" of the corrugated plastic board causes the edge portion thereof, beyond the slit, to spring back to its original thickness and thereby lock the edge of the plastic board within the slot of the molded plastic connector.

8 Claims, 2 Drawing Sheets

CORRUGATED PLASTIC BOARD ASSEMBLIES

BACKGROUND OF THE INVENTION

The present invention relates to novel assemblies of conventional corrugated plastic board sheets and molded plastic connector strips or pieces which unite and lock said sheets together to produce useful products such as containers, planters, toys, wallboard panelling,-house siding, and the like.

Corrugated plastic board is a laminate of exterior sheets of plastic film and an interior corrugated sheet of plastic film, similar in structure to corrugated paper board or cardboard. Reference is made to U.S. Pat. Nos. 3,837,973 and 3,999,928 for their disclosure of suitable corrugated board of synthetic thermoplastic film and methods for producing such board.

Corrugated plastic board has many advantages over conventional corrugated paper board or cardboard due to its strength, resistance to water and other liquids, resiliency or resistance to permanent compression or collapse, inertness or resistance to rotting, staining, etc. However, corrugated plastic board also has some disadvantages due to its nature. The relative inertness and nonabsorbent nature of corrugated plastic board make it difficult to unite sheets or pieces of such board to each other by means of adhesives, as is most common with corrugated paper board. Also, the "memory" properties of the thermoplastic film components of the plastic board make it difficult to bend or fold and retain such plastic board permanently in a direction perpendicular to the length of the corrugations, as is common with the forming of corrugated paper board into cardboard boxes and other structures.

Attempts to connect panels or sheets of corrugated plastic board to each other by connector strips or pieces having frictional engagement means are unsuccessful because of the slippery nature of the surface of plastic films which enables the plastic board to pull out of engagement under the application of stress.

It is known to connect solid, unitary plastic sheets or panels to molded plastic connectors by providing thru-holes in the plastic sheet or panel, which holes receive lock ramps, detents or protrusions present on the connector to provide locking engagement. Reference is made to U.S. Pat. Nos. 3,913,774 and 4,002,261 for their disclosure of such structures, although neither patent involves the use of corrugated plastic board. The main disadvantage of the structures of these patents is the necessity for thru-holes in the sheets or panels being connected, which destroys the liquid impermeability of the sheets or panels or of the containers formed therefrom. Another disadvantage, such as of the assembly of U.S. Pat. No. 3,913,774, is the requirement of spaced, opposed lock ramp and straddling means for flexing the plastic wall member in opposite directions during assembly. The flexibility requirement, and the projection of the straddling members into the receiving slot of the connector members, limits the thickness of the wall members which can be united by such means.

SUMMARY OF THE INVENTION

The present invention relates to novel assemblies of sheets or pieces of corrugated plastic board and molded plastic connector strips or pieces, and is characterized by the presence of cooperative engagement means, on both the plastic board and on the connectors, which enable the two elements to be interlocked in simple manner and to be resistant to unlocking. Such interlocking does not require the making of thru-holes in the corrugated plastic board, which would destroy the liquid-impermeability thereof, nor does it require that the corrugated plastic board be flexed in a direction perpendicular to the length of its corrugations, a direction in which corrugated plastic board is resistant to flexing.

The novel engagement means of the present assemblies utilize the essential structure of corrugated plastic board and the inherent memory properties of the component films thereof to provide connection sites which do not destroy the liquid-impermeability of the plastic board, which do not flex or bend the board, and which permit the board to be locked within a receptive slot having a width equal to or less than the normal relaxed thickness of the plastic board, thereby enabling the use of relatively thick plastic board and assuring tightness of fit, leak resistance, and compatability of the connector means with corrugated plastic boards of different thicknesses.

BRIEF DESCRIPTION DRAWINGS

DISCUSSION OF THE DRAWINGS

Figure 1:
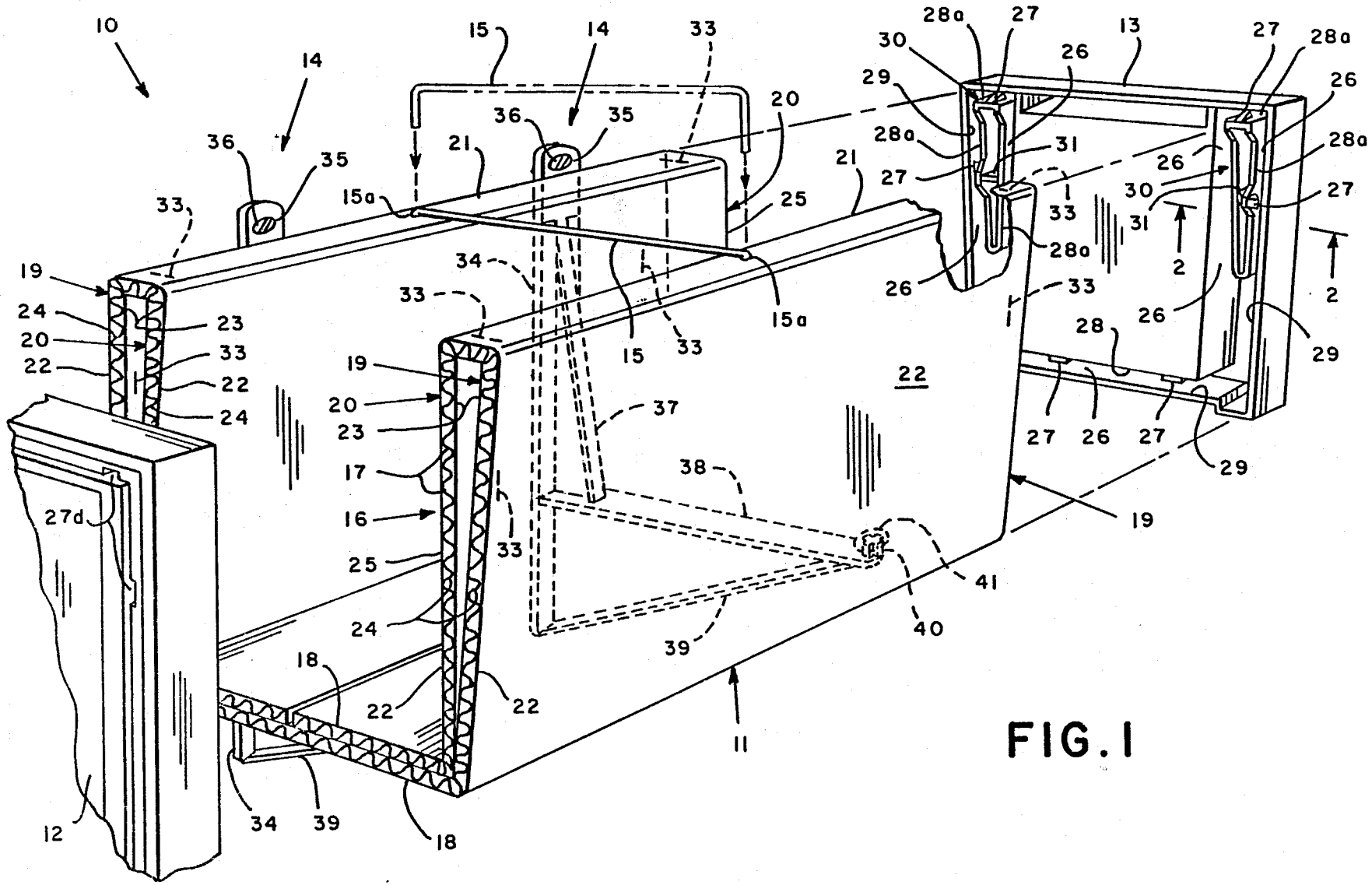
FIG. 1 is a perspective sectional view of a planter box assembly according to one embodiment of the present invention, illustrating end connector pieces or panels in position for attachment to a particular double-thickness corrugated plastic board body member.

In FIG. 1 the illustrated preassembly comprises a planter 10 or flower box having an elongate corrugated plastic board body member 11, opposed molded plastic connector panels 12 and 13, one of a pair of spaced mounting members 14, and an upper brace member 15.

The plastic board body member 11 comprises a length of corrugated plastic board 16 which is folded over itself in a direction parallel to the direction of the corrugations 17 to form a double thickness at the floor 18 of the planter 10 and side walls 19 and 20 which diverge upwardly to form single thickness, relatively wide top walls 21.

The corrugated plastic board 16 consists of a lamination of smooth outer films 22 and inner films 23 of synthetic thermoplastic material, such as polyethylene, and a corrugated interior film 24 of the same or a different synthetic thermoplastic material, the board 16 being of uniform width so as to have uniform, straight opposed edges 25 in a direction perpendicular to or transverse the length of the corrugations 17.

The connector panels or caps 12 and 13 of FIG. 1 are identical in structure and, therefore, are interchangeable. The most essential features thereof, relative to the present invention, are the receptive continuous slots 26, which receive the uniform edges 25 of the corrugated plastic board body member 11, and the six spaced locking ramps 27 molded into an inside wall 28 or **28*a*** which, with opposed outside wall 29, forms the retaining portions of the continuous slot 26 on each of the connector panels or caps 12 and 13. The locking ramps 27 comprise narrow projections having surfaces 27*a* which taper outwardly and downwardly from walls 28 and 28*a*, adjacent the entrance of the slot 26, to gradually narrow the width of the slot to a thickness which, in the area of walls 28*a*, may be as small as the compressed thickness of the three films forming the plastic board laminate and, in the area of wall 28, is wider to accommodate the double ply of laminate. Each locking ramp 27 terminates sharply at its point 27*b* of maximum height to provide a narrow locking surface 27*c* which extends perpendicularly back in to wall 28 or 28*a* and which is spaced upwardly from the floor 32 of the slot 26, as illustrated by FIG. 2 of the drawing.

The side walls 19 and 20 of the plastic board member 11 are supported in spaced relation to form the top walls 21 by engagement within the portion of the slot 26 surrounding the interior projecting wall members 30 present adjacent the upper ends of the caps 12 and 13. Wall members 30 provide interior walls 28*a* forming between themselves and opposed outside wall 29 portions of slot 26 which receive a single ply of the plastic board for engagement with the two locking ramps 27 present on the wall members 30. Also, as shown in FIGS. 1 and 2 the side wall ramps 27 of the members 30 are reinforced by cross braces 31 in the illustrated embodiment.

Figure 2:
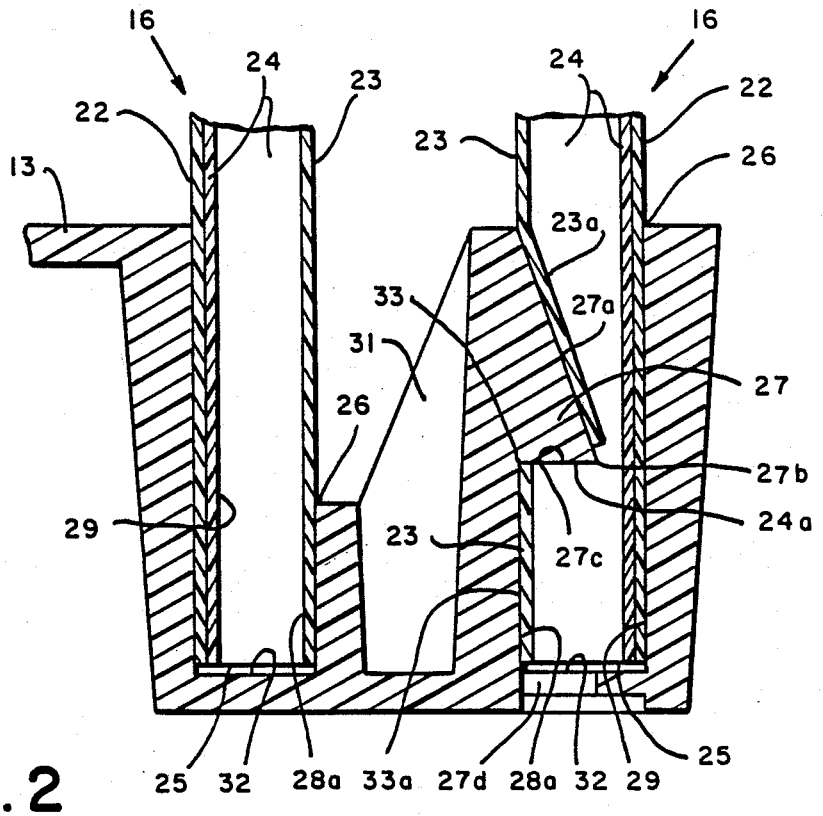
FIG. 2 is a cross-sectional view taken along the line 2—2 of FIG. 1 but illustrating the engagement of the corrugated plastic board body member within the connector piece.

The locking engagement of the present corrugated board to each of the locking ramps 27, as most clearly illustrated by representative FIG. 2, is made possible by providing the plastic board 16 with a plurality of spaced slits 33, shown in FIG. 1, which are parallel to and spaced a predetermined distance inwardly from the uniform edges 25 of the board 16 in areas corresponding to the predetermined locations of the locking ramps 27 on each of the connector caps 12 and 13. The slits 33 are made through the inner film 23 and extend at least partially through the interior corrugated film 24, in a direction across the convolutions, but do not extend to or through the outer film 22. Thus, the latter retains its liquid-impermeability.

Referring again top FIG. 2, each transverse slit 33, parallel to the length of the adjacent edges 25, is spaced inwardly therefrom by a distance slightly less than the distance by which the locking surface 27*c* of each ramp 27 is spaced from the floor 32 of the receiving slot 26.

The insertion of the edge 25 of the plastic board 26 into the continuous receiving slot 26 causes narrow areas of the plastic board 16 to be compressed in locations corresponding to the locations of the slits 33 and the ramps 27. The outer film 22 of the board 16 is not bent or deflected and may in fact be a rigid, flex-resistant stratum. Only the inner film 23 and the interior corrugated film 24 are compressed, and this is facilitated by the transverse slits 33. The insertion of the plastic board causes the inner film 23 to be deflected inwardly as it passes over the tapered surface 27*a* of each ramp 27. This continues until each slit 33 passes the point 27*b* of maximum height or the crest of each ramp 27, at which position the edge 25 of the plastic board 16 is seated at the floor 32 of the connector slot 26.

As shown by FIG. 2, in such position the edge portion 33*a* of the outer film 23, outwardly from each slit 33 to the adjacent edge 25, springs or relaxes back to the original or normal thickness of the plastic board 16 because of the inherent memory properties of the thermoplastic films together with the spring forces exerted by the corrugated interior film portion 24*a* which is segregated by the depth of slit 33 from the other portion of the corrugated film 24 which remains compressed beneath deflected inner film portion 23*a*. Thus, the corrugated plastic board 16 is securely locked to the connector 13 (and 12) at each location of a lock ramp 27 and a board slit 33.

Since the corrugated plastic board 16 is compressible to a thickness which approximates the combined thicknesses of the three films 22, 23 and 24 constituting the board 16, i.e., 10% or less of the normal thickness of the board 16, it is clear that relatively thick plastic board stock can be interlocked by means of the present engagement means provided that the entrance of the receiving slot 26 is wide enough to receive the edges 25 of the board 16. If desired, the receiving slot 26 may be tapered inwardly so as to be most narrow adjacent the floor 32 thereof. This permits the tight engagement of boards 16 of various thicknesses, due to the compressibility of such boards and their ability to relax and spring back as much as necessary in areas 33*a* to conform to the shape of the slot 26.

FIG. 1 illustrated a container consisting of a planter 10 or flower box designed for use in association with a pair of spaced mounting members 14 or wall brackets, one of which is illustrated in detail. The mounting brackets 14, which may be molded from strong plastic composition, each comprise a vertical wall brace 34 having an upper bore 35 designed to receive a wall fastener 36, such as a screw, a downwardly and outwardly inclined planter brace 37 designed to engage and support the confirming wall surface of the planter 10, a horizontal floor support member 38 attached to braces 34 and 37, and an upward and outward floor brace 39 attached to the base of wall brace 34 and the outer end of floor support member 38. An interconnection is provided between the mounting members 14 and the planter 10 to prevent sliding movement of the latter. Thus, the floor support member 38 of each member 14 is provided with an upward projection 40 or retainer adjacent the outer end thereof, and the floor 18 of the planter 10 is provided with cooperative spaced bores 41 in the underside thereof, each positioned to receive a projection 40 of a mounting member 14 to lock the planter 10 against sliding movement relative to the floor support members 38. If desired, the bores 41 need not extend completely through the double thickness of the planter floor 18, and the projections 40 are of corresponding reduced height, whereby the planters can be water-tight. Brace 15 preferably is a section of heavy wire, bent as illustrated, to provide ends which are inserted into holes 15*a* centered in the upper walls 21, to further stabilize the walls of the planter against bowing under the effect of the weight of the contents of the planter.

In the embodiment of FIGS. 1 and 2, the end caps 12 and 13 are provided with access wall passages 27*d* in areas corresponding to the location of each of the locking ramps 27, permitting the insertion of a narrow flat tool, such as a screwdriver blade, between the expanded inner film portion 33*a* and wall 28*a*. for purposes of depressing portion 33*a* outwardly beyond the tip 27*b* of the locking ramp to release the locking engagement of each ramp 27 for disassembly of the planter 10. Access wall passages 27*d* may be eliminated in cases where the ability to disassemble the planter is not desirable.

Figure 3:
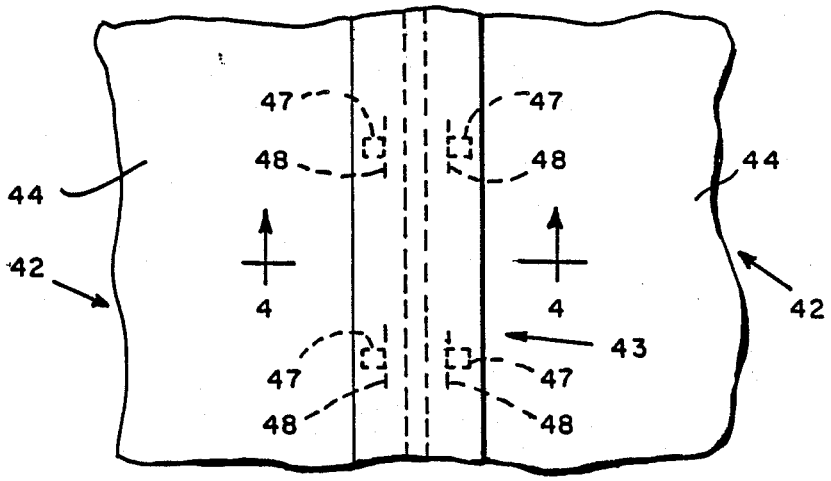
FIG. 3 is a front view of two flat panels or sheets of corrugated plastic board united by means of a connector strip, according to another embodiment of the present invention.
Figure 4:
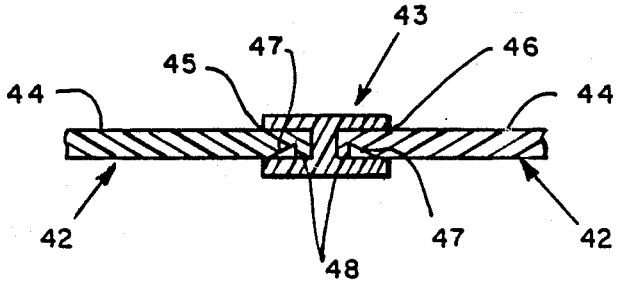
FIG. 4 is a cross-section taken along the line 4—4 of FIG. 3.

The novel assemblies of the present invention are also useful for a variety of other structures, including the panel structures illustrated by FIGS. 3 and 4. In FIG. 3, two flat panels 42 of corrugated plastic board are united by means of an elongate flat connector strip 43 which may be provided with nail holes for purposes of fastening the strip 43 to a wall. The exposed or outer film surfaces 44 of the panels 42 may be colored, embossed, printed, coated or otherwise rendered decorative in order to provide a decorative, weather-resistant and washable wall-or house-covering. The connectors 43 may be molded from colored plastic composition and/or embossed or otherwise treated so that they either blend with the panels 42 or provide a desired contrast therewith.

As illustrated by FIG. 4, the connector strips 43 contain opposed elongate slots 45 and 46 having a width similar to the thickness of the corrugated plastic board panels 42, and each containing a plurality of uniformly spaced locking ramps 47 similar in design and function to the ramps 27 of FIGS. 1 and 2. Ramps 47 project upward or outward to engage spaced slits 48 in the rear film surface, similar to the slits 33 of FIGS. 1 and 2, so that the insertion of the straight edges of the panels 42 into the slots 45 and 46 of the connector 43 causes the edges to be compressed by engagement with the ramps 47 and to move to the floor of the slots 45 and 46 at which position the slits 48 pass over and behind the ramps 47 to lock the panels 42 to the connector 43. The slits 48 are parallel to the panel edges, closely spaced therefrom and uniformly spaced from each other by a distance enabling alignment with and engagement with a locking ramp 47. If desired, the slits 48 may be portions of a continuous slit through only a portion of the full thickness of the corrugated plastic board panels, thereby providing universal alignment with the locking ramps 47.

While the connectors 43 of FIGS. 3 and 4 are flat members, it will be apparent that they may also be in the form of inner and outer angular members which enable the attachment of panels of the present corrugated plastic board over the entire surface area of a room, house or other structure or enable the attachment of such panels to each other to form a container, doll house or other structure which does not require the use of molded plastic connector panels or end caps such as 12 and 13 of FIGS. 1 and 2. Plastic connector strips of these configurations, devoid of locking ramps, are conventional for the frictional engagement or connection of conventional wall panels of wood or solid composition.

Variations and modifications of the present invention will be apparent to those skilled in the art within the scope of the present claims.

I claim:

1. An assembly comprising a panel of corrugated plastic board having front and rear plastic films and an interior flexible corrugated plastic film which is sandwiched therebetween and comprises corrugations attached to each of said plastic films to form said corrugated plastic board, said panel having an edge which transverses the corrugations of said interior film, and at least one of said plastic films being flexible and having an elongate slit which is parallel to and spaced inwardly from said edge, and at least one end cap member having a vertical floor supporting opposed walls which are closely spaced from each other to form therebetween an elongate slot of sufficient width to receive said edge of the panel, said slot terminating at said floor and having a width similar to the thickness of said panel so that the panel substantially fills the width of the slot, said cap member containing at least one locking ramp which projects from one of said opposed walls and which tapers into said slot to provide a graduated restriction in the width thereof which graduated restriction terminates in a restricted width which is substantially more narrow than the normal thickness of said panel, each said ramp terminating in a retainer wall which extends substantially perpendicular to and spaced from the floor of said slot by a distance which is slightly greater than the distance between the edge of the panel and the elongate slit which is spaced inwardly from said edge, the edge of said panel being inserted into said slot, with the slit film surface being adjacent the ramped wall of the cap member, to cause the slit film surface, adjacent said edge, to engage and be gradually compressed by each said locking ramp until said edge approaches the floor of the slot and the elongate slit of the film surface passes beyond the termination of each said locking ramp, whereby the portion of said panel, inwardly form said edge to said slit, expands to engage said retainer wall and lock said panel to said cap member.

2. An assembly according to claim 1 in which said elongate slit is segmented to form a plurality of narrow slits spaced along said edge of the panel, and said cap member contains a plurality of said locking ramps spaced from each other for alignment with and engagement with one of said slits.

3. An assembly according to claim 1 comprising at least one molded plastic cap member.

4. An assembly accoridng to claim 1 comprising an elongate container having an elongate body section consisting of said panel of flexible corrugated plastic board contoured to form at least the rear, floor and front panels of said container, and two said cap members which comprise opposed end caps of molded plastic composition, each said cap member containing a said elongate slot which receives and locks the opposed edges of said elongate contoured body section to enclose the ends of said container.

5. An assembly according to claim 4 comprising a planter having said elongate rear, floor and front panels and said end caps, and having associated therewith a pair of spaced wall brackets, each said bracket having a horizontal support means for supporting the underside of the floor panel of the planter, each said support means including at least one upward projection adjacent the outer end thereof, and the underside of said planter having at least two spaced upward bores in said floor panel positioned to receive the upward projections of said support means of said spaced brackets to prevent sliding motion of said planter relative to said support means.

6. An assembly according to claim 5 in which said projections have a height less than the thickness of said floor panel of the planter and said bore do not extend completely through said floor panel of the planter, whereby said floor panel is water-impermeable.

7. An assembly according to claim 4 in which said rear, floor, and front panels comprise a continuous length of said flexible corrugated plastic board which is folded over itself to form an elongate contoured body section having a double thickness of said flexible corrugated plastic board.

8. An assembly according to claim 7 in which said contoured body section comprises said front and rear panels, each consisting of inner and outer plies of said plastic board, which plies diverge from each other upwardly in increasing spaced relation before joining to form upper front and rear wall surface, the elongate slot in said end cap members having a corresponding shape for reception of and engagement with the edges of the continuous length of said flexible plastic board.

* * * * *